US005595340A

United States Patent [19]

Skinner

[11] Patent Number: 5,595,340

[45] Date of Patent: Jan. 21, 1997

[54] PACKAGING

[75] Inventor: Edward A. Skinner, Welwyn Garden City, United Kingdom

[73] Assignee: Elopak Systems A.G., Glattbrugg, Switzerland

[21] Appl. No.: 549,257

[22] Filed: Oct. 27, 1995

[30] Foreign Application Priority Data

Oct. 28, 1994 [GB] United Kingdom ..... 9421722

[51] Int. Cl.[6] ..... B65D 5/74

[52] U.S. Cl. ..... 229/216; 229/207; 229/242

[58] Field of Search ..... 229/125.42, 207, 229/216, 217, 214, 241, 242

[56] References Cited

U.S. PATENT DOCUMENTS

| | | | |
|---|---|---|---|
| 3,186,621 | 6/1965 | Suensson | 229/207 |
| 3,347,446 | 10/1967 | Guyer et al. | 229/207 |
| 3,797,726 | 3/1974 | Reil | 229/216 |
| 3,957,180 | 5/1976 | Skillman | 229/216 |
| 4,301,927 | 11/1981 | Carlsson et al. | 229/216 |
| 4,327,833 | 5/1982 | Kuckenbecker | 229/216 |
| 4,655,387 | 4/1987 | Magnusson | 229/216 |
| 4,915,236 | 4/1990 | Kamin et al. | 229/216 |

*Primary Examiner*—Gary E. Elkins

*Attorney, Agent, or Firm*—Reising, Ethington, Barnard & Perry

[57] ABSTRACT

A fin-sealed, flat-topped, liquid-packaging carton with substantially triangular flaps of its tope end closure turned down and tacked to adjacent body panels has the horizontal part of its fin heat and pressure adhered to the top wall along approximately only that half of its length further from the triangular flap which will provide a pouring spout so that turning upwards of the spout end of the fin from its position flat against the top wall tends to pull upwards the central part of the top wall. Two score lines extending divergingly from the spout end of the top wall at respective opposite sides of the fin to respective corners of the opposite end of the top wall are thereby broken outwards rather than inwards.

18 Claims, 2 Drawing Sheets

PACKAGING

BACKGROUND OF THE INVENTION

1. Field of the Invention

This invention relates to packaging, in particular to a packaging container and to a sheet material blank from which the container can be made.

2. Description of the Prior Art

Various packaging cartons and blanks from which the cartons can be made are known from, for example, EP-A-0132824; EP-A-0465834; EP-A-0547987; FR-A-1437100; FR-A-2535685; GB-A-466947; GB-A-1118696; U.S. Pat. No. 2,097,647; U.S. Pat. No. 3,447,732; U.S. Pat. No. 3,9057,180; U.S. Pat. No. 3,998,380 and U.S. Pat. No. 4,588,122. Of these, U.S. Pat. No. 3,957,180 and U.S. Pat. No. 4,588,122 each disclose a sheet material blank comprising a row of five body panels, a row of five bottom and closure panels, a row of five top closure obturating panels and a row of five top closure sealing panels, all extending parallelly to each other and with score lines generally dividing the sheet material into the various panels. Two alternate inner panels of the row of the top closure obturating panels are divided into triangular sub-panels by oblique score lines. In the forming of the carton, the rows are folded about score lines perpendicular to the rows and the end panels of each row are sealed together to form a liquid tight seal extending along the carton sleeve so formed. The bottom end closure panels are then folded together and sealed to form a liquid tight bottom end closure and the carton is then filled. After filling, the top end closure panels are folded to cause each group of triangular sub-panels to project outwards and to fold upon itself that sealing panel adjacent the group so that the sealing panels extend as a fin in the form of generally two thicknesses of the sheet material, whereupon the sealing panels are sealed together to form a liquid tight sealing fin sealing the top end closure. The sealing fin is turned down to lie flat against parts of the obturating panels at one side of a central plane of the carton. In U.S. Pat. No. 3,957,180, the outwardly projecting groups of triangular sub-panels, with the adjacent end zones of the sealing fin and forming triangular flaps at respective ends of the fin, are turned downwards to lie flatly against the respective adjacent body panels and are tacked to those body panels. In U.S. Pat. No. 4,588,152, the two triangular flaps are instead turned upwards to lie flatly against the top wall of the carton and are tacked to that wall. EP-A-0465834 discloses a carton similar to that of U.S. Pat. No. 3,957,180, except that it has been made from a web constituting, in effect, a row of such blanks and progressively folded into a tube which is progressively filled and cross-sealed and severed to form sealing fins in both the top and bottom closures of each carton.

To open the carton of U.S. Pat. No. 3,957,180, one of the triangular flaps is detached from its adjacent body panel and lifted to a horizontal condition. Then its sealing panel, which is in a condition sealed to itself, is torn or cut away from the adjacent sealing panels and thereupon pulled away from those adjacent panels to tear off the adjacent tips of the adjacent group of triangular sub-panels to form a pouring opening. The sheet material at the two nearby corners of the carton is provided with diamond-shaped arrays of score lines whereby, when the consumer grasps the carton across those corners between the thumb and fingers, the opening is brought to a shape more appropriate for pouring.

In EP-A-0465834, opening is achieved by again detaching one of the triangular flaps from its adjacent body panel, fitting in and tearing off a section of the sealing fin along lines of perforation extending from the middle of the fin to the apex of the triangular flap to reveal a pouring opening. In order to obtain a desired raising of the rear end of the pouring opening, the obturating panels of the top end wall of the carton are provided with two score lines which diverge from the rear end of the opening. The rear part of that wall is provided with two other score lines which, together with the two score lines diverging from the rear end of the opening, enclose a central, generally, rhomboid area of the wall. Thereby the wall is intended to acquire a tendency to fold at those score lines in conjunction with the folding up and widthwise squeezing of the triangular flap when the carton is to be opened. This is intended to make it possible for the rear end of the pouring opening to be raised a sufficient extent in relation to the surface of the packaged liquid that air can flow into the carton even when the consumer has not opened it completely or when the liquid, owing to its viscosity, has an increased tendency to surge.

SUMMARY OF THE INVENTION

According to one aspect of the present invention, there is provided a packaging container including an end closure comprised of a first plurality of container wall portions forming an end wall of said container, a second plurality of container wall portions sealed together to form a sealing fin and, in the regions of the respective ends of the sealing fin, third and fourth pluralities of container wall portions flattened together to form respective triangular flaps extending from respective opposite edges of said end wall, at least said third plurality of container wall portions forming a closed, openable, pouring spout, said sealing fin extending face-to-face with said end wall, characterized in that said sealing fin is substantially unadhered to said end wall in a first zone near said third plurality of container wall portions and is adhered to said end wall in a second zone further from said third plurality of container wall portions than is said first zone.

Owing to the adhesion between the sealing fin and the end wall in the second zone, turning of that end part of said sealing fin nearer said third plurality of container wall portions from its position face-to-face with the end wall into a position roughly perpendicular to said end wall prior to cutting or tearing off of that end part and parts of the third plurality of container wall portions, to open the spout, can tend to pull outwardly a central region of the end wall, so promoting appropriate opening of the spout; while the feature that the sealing fin is substantially unadhered to the end wall in the first zone allows the end part of the sealing fin to be readily turned from its position face-to-face with the end wall to its roughly perpendicular position.

According to a second aspect of the present invention, there is provided a sheet material blank from which a packaging container is to be made, comprising:

a row of body panels comprised of first, second, third and fourth body panels;

a row of end closure obturating panels extending substantially parallelly to said row of body panels and comprised of first and second substantially rectangular panels extending from the first and third body panels, respectively, and also comprised of first and second groups of substantially triangular panels extending from the second and fourth body panels, respectively;

a row of end closure sealing panels extending substantially parallelly to said row of body panels and to the row of end closure obturating panels;

at least the panels of said first group being designed to form an openable pouring spout of the container to be made;

and lines of said weakness bounding the panels; characterized by two lines of weakness extending, in said first and second substantially rectangular panels, respectively, from those corner zones of the first and second substantially rectangular panels nearer said spout and the sealing panels, towards the diametrically opposite corner zones of the first and second substantially rectangular panels, respectively.

According to a third aspect of the present invention, there is provided a packaging container of sheet material, including an end closure comprised of a first plurality of container wall portions forming end wall means at one end of said container, a second plurality of container wall portions sealed together to form a sealing fin and, in the regions of the respective ends of the sealing fin, first and second groups of substantially triangular container wall portions extending from respective opposite edges of said end wall means, at least the first group of triangular container wall portions forming a closed, openable pouring spout, characterized in that first and second lines of weakness in said end wall means extend, in a diverging manner, from respective zones of said end wall means adjacent said first group and at respective opposite sides of said sealing fin, towards respective corners of said end wall means further from said first group.

The provision of the first and second lines of weakness according to these two aspects of the invention has the advantage of promoting maintenance of the spout in an appropriate open condition during use.

BRIEF DESCRIPTION OF THE DRAWINGS

In order that the invention may be clearly understood and readily carried into effect, reference will now be made, by way of example, to the accompanying drawings, in which.

DESCRIPTION OF THE PREFERRED EMBODIMENT

Figure 1:
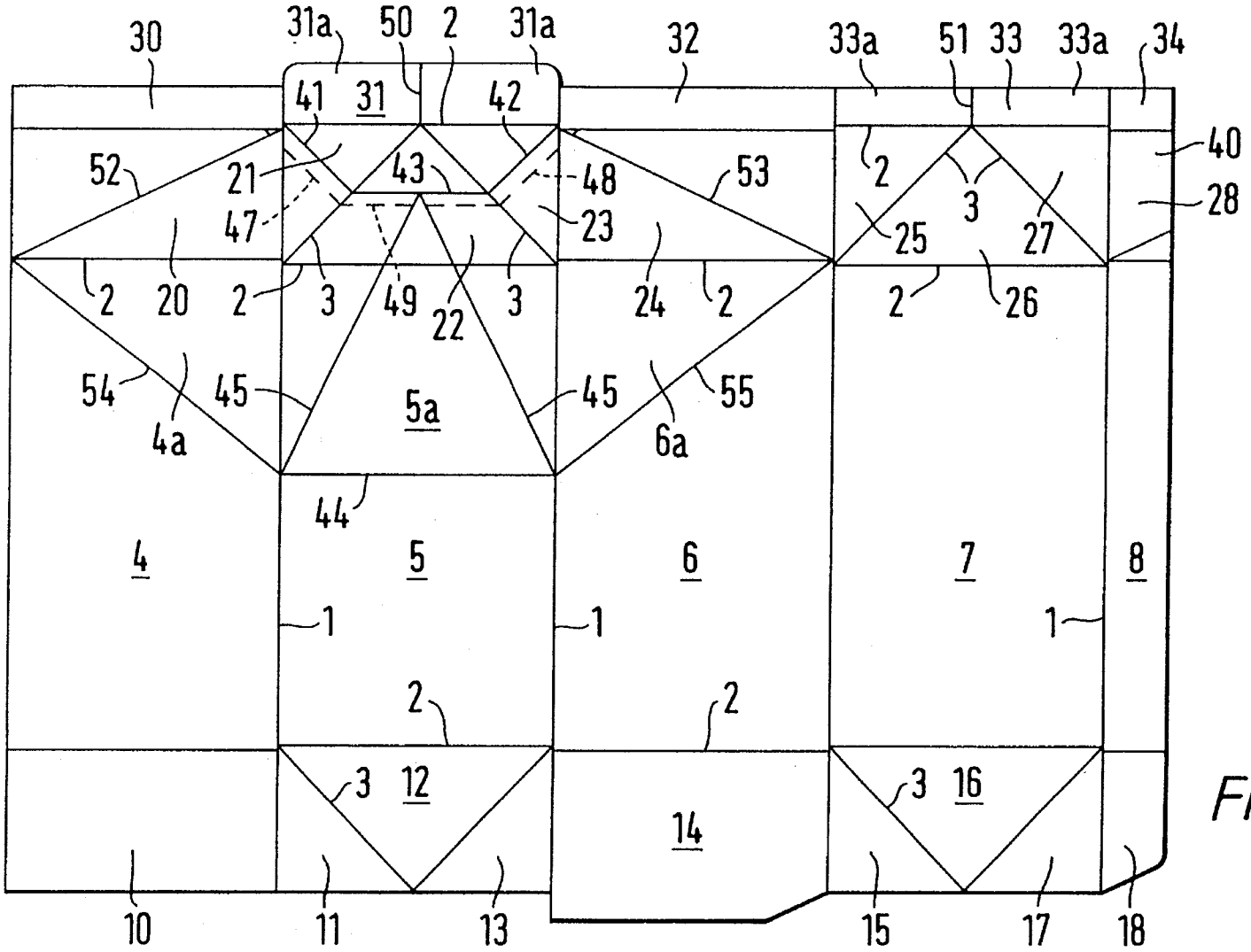
FIG. 1 shows a plan view of the outside surface of a blank from which a flat-topped, liquid packaging carton is to be made.

Referring to FIG. 1, the blank is a laminate consisting of a plurality of layers, which include at least a paperboard layer, an inside surface thermoplastics layer and an outside surface thermoplastics layer. The blank is formed with four parallel score lines 1 which, with score lines parallel to each other but perpendicular to the score lines 1, and with oblique score lines 3, bound panels arranged in rows along the blank. The panels include a row of body panels 4 to 7, each of which is rectangular. The panels also include a row of bottom end closure panels 10 to 17, a row of top end closure obturating panels 20 to 27 and a row of top end closure sealing panels 30 to 33. At that edge of the blank adjacent the body panel 7 is a side seam strip 40 consisting of panels 8, 18, 28 and 34. The panels 20 and 24 are rectangular and extend from the body panels 4 and 6. The panels 21 to 23 are triangular and constitute a group of three triangular panels, as do the panels 25 to 27. The group 21 to 23 extends from the body panel 5, while the group 25 to 27 extends from the body panel 7. The sealing panels 30 to 33 extend respectively from the panel 20, the group of panels 21 to 23, the panel 24 and the group of panels 25 to 27. The sealing panel 31 projects outwardly beyond the adjacent sealing panels 30 and 32. Partial depth cuts 41 and 42 are formed in the outside surface of the blank and extend from the respective intersections of the score line 2 bounding the sealing panel 31 with the score lines 1 bounding that same panel, to the middles of the oblique score lines 3 bounding the respective triangular panels 21 and 23 in which the cuts 41 and 42 are formed. A partial depth cut 43 is formed in the outside surface of the triangular panel 22 so as to extend from one to the other of those ends of the cuts 41 and 42 at the score lines 3. A score line 44 extends from one to the other of the score lines 1 bounding the body panel 5 and is located about half way between the score lines 2 bounding the panel 5. From the ends of the score line 44 respective score lines 45 extend to the midpoint of the cut 43. Extending parallelly to the array of cuts 41 to 43, but so as to be slightly nearer the center of the blank than is the array 41 to 43 is an array of partial depth cuts 47 to 49 formed in the inside surface of the blank. A short score line 50 parallel to the score lines 1 divides the sealing panel 31 into two equal subpanels 31*a*, while a short score line 51 parallel to the score lines 1 divides the sealing panel 33 into two equal subpanels 33*a*. Score lines 52 and 53 extend, in the panels 20 and 24, respectively, from those corners of the panels 20 and 24 nearer the group of panels 21 to 23 and respectively nearer the sealing panels 30 and 32, to the diametrically opposite corners of the panels 20 and 24. Score lines 54 and 55 may be provided in the panels 4 and 6, extending from the respective ends of the score line 44 to those respective ends of the score lines 52 and 53 at the opposite sides of the respective panels 4 and 6. The score lines 54 and 55 bound, with the respective score lines 1 bounding the panel 5 and with the respective score lines 2 between the panels 4 and 20 and the panels 6 and 24, respective triangular subpanels 4*a* and 6*a* of the panels 4 and 6, respectively.

To form a carton from the blank of FIG. 1, first the strip 40 is heat and pressure sealed to the inside surface of the opposite edge zone of the blank, so as to form a sleeve. Subsequently, the panels 10 and 17 (and 18) are heat and pressure sealed together to form a bottom end closure for the carton. The open topped carton is then filled, for example with milk or orange juice. Thereafter, the top closure panels 20 to 27 (and 28) and 30 to 33 (and 34) are brought together, with the panels 20, 24, 30 and 32 being turned inwards and the panels 21 to 23, 25 to 27, 31 and 33, being turned outwards. The sealing panel 32 is heat and pressure sealed face-to-face to the panel 30 (and 34), whilst the subpanels 31*a* are heat and pressure sealed face-to-face with each other, as are the subpanels 33*a*. In this way, a sealing fin is formed, with the panels 21 to 23 being flattened together to form a triangular flap, and the panels 25 to 27 being flattened together to form another triangular flap, such flaps extending from respective opposite edges of a top closure end wall formed by the rectangular panels 20 and 24 (and 28). Then the sealing fin 30 to 34 is turned to one side to a position face-to-face with the end wall and the triangular flaps and is heat and pressure adhered thereto to an extent to be described, whereafter the two triangular flaps, with their respective associated end parts of the fin are turned down and are tacked to the adjacent body panels 5 and 7 of the carton.

Figure 2:
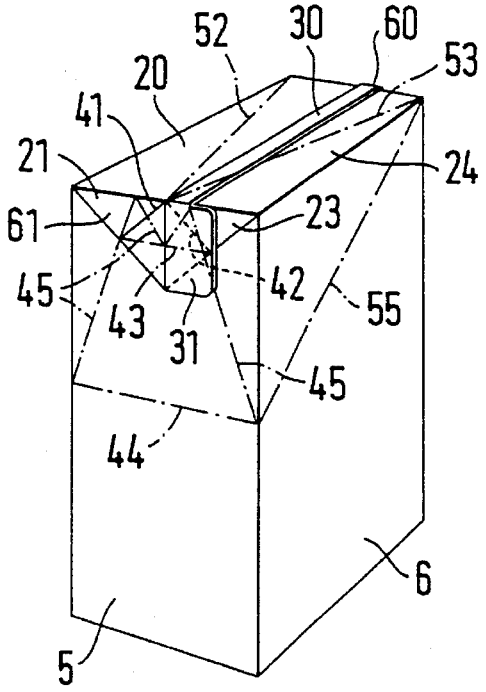
FIG. 2 shows a top perspective view of a formed, filled and sealed carton made from the blank of FIG. 1.

The carton thereby produced is shown in FIG. 2. The sealing fin 60 is seen, with one of its end parts constituted by the panel 31. The triangular flap constituted by the group of panels 21 to 23 is seen and is referenced 61. The score lines 44, 45, 52, 53, 54 and 55 are shown in dot-dash lines, but this has been done purely to improve the clarity of the Figure. It will be appreciated that the central part of the sealing fin 60 constituted by the panels 30 and 32 (and 34) extends substantially parallelly to the end wall constituted by the rectangular panels 20 and 24, while the two end parts of the fin 60, which are constituted by the panels 31 and 33, respectively, extend substantially perpendicularly to that end wall. The sealing fin 60 has been heat and pressure adhered to the panel 24 of the end wall along approximately only one half of the central part of the fin, that half being the half further from the group of panels 21 to 23. In other words, the panel 32 has been heat and pressure adhered to its adjacent rectangular panel 24 along only that half to the panel 32 nearer the panel 33.

Figure 3:
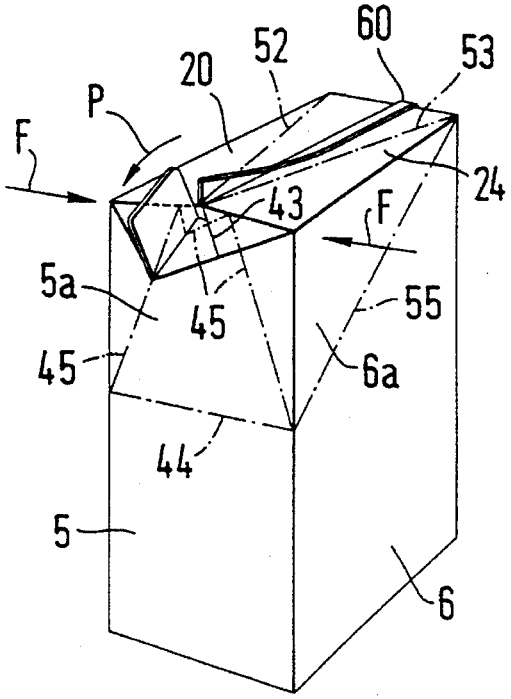
FIG. 3 is a view similar to FIG. 2, but of the carton at a stage in the process of being opened.
Figure 4:
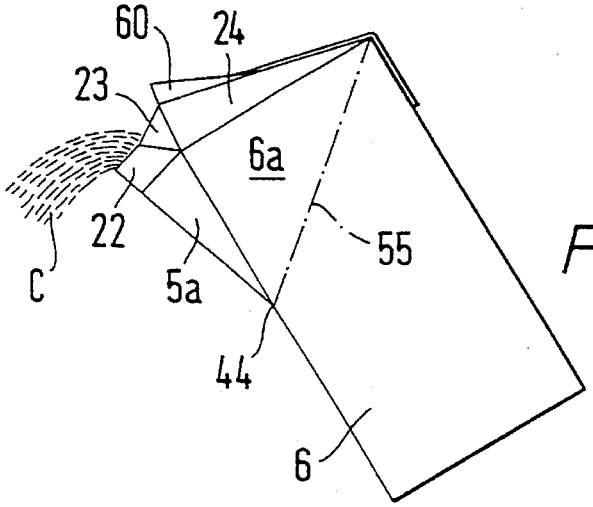
FIG. 4 is a side elevation of the carton with a spout thereof fully opened and contents being poured therefrom.

To open the carton so as to provide a pouring spout therein, a consumer first untacks the triangular flap 61 from the wall 5 and brings it to a roughly horizontal position. Then he seizes that end part of the fin 60 constituted by the panel 31, which projects further than the rest of the fin 60 in order to identify it for seizure and in order to facilitate seizure thereof, and turns it so that it projects upwards. This action tends to turn with it the adjacent end region of the central part of the fin 60, but not the remainder of that central part, so that such remainder, adhered to the end wall, is thereby caused to pull upwards the central part of the end wall 20, 24. When opening the carton, the consumer would tend to manipulate the end part 31 with one hand, while grasping the upper part of the carton with the other hand in such manner as to apply a squeezing force as indicated by the arrows F in FIG. 3. The pulling upwards of the central part of the end wall 20, 24 tends to encourage outward breaking of the score lines 52 and 53 and so encourages the end wall 20, 24 to bow outwards rather than inwards under the squeezing force F. To open the spout, the consumer then pulls the end part 31 away from the central part of the fin and away from the panel 5, in the sense of the arrow P in FIG. 3, so tearing the end part 31 from the remainder of the fin 60, the tearing following the portions of the score lines 1 at the ends of the panel 31, the cuts 41 and 42 and 47 and 48, and finally the cuts 43 and 49, whereafter the consumer disposes of the torn off region in an environmentally friendly manner. The pulling in the sense P, combined with the squeezing force F, tends to turn the upper part 5*a* of the panel 5 about the score line 44 and to break the score lines 45 outwards so as to cause that upper part 51 and the panel 22 to bow outwards. Thus, with the end wall 20, 24, the upper part 5*a* and the panel 22 all bowed outwards, and maintained so bowed under the squeezing force F naturally applied to the upper half of the carton by the consumer while pouring, a reliably wide spout is formed throughout pouring of the contents C from the carton, as indicated in FIG. 4. If the score lines 54 and 55 are provided, they facilitate pressing inwards of the upper parts of the panels 4 and 6, respectively, under the squeezing force F. It will be noted that the score lines 44 and 52 to 55 bound the lead in to the spout and so promote more accurate formation of the inner, wide part of the spout.

I claim:

1. A packaging container including an end closure comprised of a first plurality of container wall portions forming an end wall of said container, a second plurality of container wall portions sealed together to form a sealing fin and, in the regions of the respective ends of the sealing fin, third and fourth pluralities of container wall portions flattened together to form respective triangular flaps extending from respective opposite edges of said end wall, at least said third plurality of container wall portions forming a closed, openable, pouring spout, said sealing fin extending face-to-face with said end wall, wherein the improvement comprises said sealing fin being substantially unadhered to said end wall in a first zone near said third plurality of container wall portions and being adhered to said end wall in a second zone further from said third plurality of container wall portions than is said first zone.

2. A container according to claim 1, wherein said first zone and said second zone are of substantially the same length as each other.

3. a container according to claim 1, wherein said first zone extends to said third plurality of container wall portions.

4. A container according to claim 1, and further comprising first and second lines of weakness in said end wall and extending, in a diverging manner, from respective zones of said end wall adjacent said third plurality of container wall portions and at respective opposite sides of said fin, towards respective corners of said end wall further from said third plurality of container wall portions.

5. A container according to claim 1, and further comprising respective lateral walls of said container extending along respective longitudinal edges of said end wall which extend from said third plurality of container wall portions to said fourth plurality of container wall portions and lateral lines of weakness in the respective lateral walls and extending obliquely from respective corner zones of said lateral walls adjacent said fourth plurality of container wall portions to respective intermediate zones at those respective edges of said lateral walls opposite said corner zones and extending from said end wall.

6. A container according to claim 1, and further comprising a front wall of said container adjacent said third plurality of container wall portions and a transverse line of weakness in said front wall and spaced from both said end wall and an opposite end wall of said container.

7. A container according to claim 6 and further comprising respective lateral walls of said container extending along respective longitudinal edges of said end wall which extend from said third plurality of container wall portions to said fourth plurality of container wall portions and lateral lines of weakness in the respective lateral walls and extending obliquely from respective corner zones of said lateral walls adjacent said fourth plurality of container wall portions to respective intermediate zones at those respective edges of said lateral walls opposite said corner zones and extending from said end wall, said transverse line of weakness extending between said respective intermediate zones.

8. A container according to claim 6, and further comprising a pair of lines of weakness extending in a divergent manner from said end wall formed by said first plurality of container wall portions to respective end zones of said transverse line of weakness.

9. A sheet material blank from which a packaging container is to be made, comprising:

a row of body panels comprised of first, second, third and fourth body panels, a row of end closure obturating panels extending substantially parallelly to said row of body panels and comprised of first and second substantially rectangular panels extending from the first and third body panels, respectively, and also comprised of first and second groups of substantially triangular panels extending from the second and fourth body panels, respectively, a row of end closure sealing panels extending substantially parallelly to said row of body panels and to the row of end closure obturating panels, at least the panels of said first group being designed to form an openable pouring spout of the container to be made, and lines of weakness bounding the panels, wherein the improvement comprises two lines of weakness extending, in said first and second substantially rectangular panels, respectively, from those corner zones of the first and second substantially rectangular panels nearer said spout and the sealing panels, towards the diametrically opposite corner zones of the first and second substantially rectangular panels, respectively.

10. A blank according to claim 9, and further comprising third and fourth lines of weakness in the first and third body panels, respectively, and extending obliquely from respective corner zones of said first and third body panels adjacent said row of obturating panels and further from said second body panel to respective intermediate zones at those respective edges of said first and third body panels bounding said second body panel.

11. A blank according to claim 9, and further comprising a transverse line of weakness in said second body panel and spaced from both said first group of substantially triangular panels at one end of said second body panel and an opposite end of said second body panel.

12. A blank according to claim 11, and further comprising third and fourth lines of weakness in the first and third body panels, respectively, and extending obliquely from respective corner zones of said first and third body panels adjacent said row of obturating panels and further from said second body panel to respective intermediate zones at those respective edges of said first and third body panels bounding said second body panel, said transverse line of weakness extending between said respective intermediate zones.

13. A blank according to claim 11, and further comprising a pair of lines of weakness extending in a divergent manner from said first group of substantially triangular panels to respective end zones of said transverse line of weakness.

14. A packaging container of sheet material, including an end closure comprised of a first plurality of container wall portions forming end wall means at one end of said container, a second plurality of container wall portions sealed together to form a sealing fin and, in the regions of the respective ends of the sealing fin, first and second groups of substantially triangular container wall portions extending from respective opposite edges of said end wall means, at least the first group of triangular container wall portions forming a closed, openable pouring spout, wherein the improvement comprises first and second lines of weakness in said end wall means extending, in a diverging manner, from respective zones of said end wall means adjacent said first group and at respective opposite sides of said sealing fin, towards respective corners of said end wall means further from said first group.

15. A container according to claim 14, and further comprising respective lateral walls of said container extending along respective longitudinal edges of said end wall means which extend from said first group of substantially triangular container wall portions to said second group of substantially triangular container wall portions, and lateral lines of weakness in the respective lateral walls and extending obliquely from respective corner zones of said lateral walls adjacent said second group of substantially triangular container wall portions to respective intermediate zones at those respective edges of said lateral walls opposite said corner zones and extending from said end wall means.

16. A container according to claim 14, and further comprising a front wall of said container adjacent said first group of substantially triangular container wall portions and a transverse line of weakness in said front wall and spaced from both said end wall means and an opposite end wall of said container.

17. A container according to claim 16, and further comprising respective lateral walls of said container extending along respective longitudinal edges of said end wall means which extend from said first group of substantially triangular container wall portions to said second group of substantially triangular container wall portions, and lateral lines of weakness in the respective lateral walls and extending obliquely from respective corner zones of said lateral walls adjacent said second group of substantially triangular container wall portions to respective intermediate zones at those respective edges of said lateral walls opposite said corner zones and extending from said end wall means, said transverse line of weakness extending between said respective intermediate zones.

18. A container according to claim 16, and further comprising a pair of lines of weakness extending in a divergent manner from said end wall means to respective end zones of said transverse line of weakness.

* * * * *

UNITED STATES PATENT AND TRADEMARK OFFICE

CERTIFICATE OF CORRECTION

PATENT NO. : 5,595,340
DATED : January 21, 1997
INVENTOR(S) : Edward A. Skinner

It is certified that error appears in the above-identified patent and that said Letters Patent is hereby corrected as shown below:

Column 1, line 14, delete "3,9057,180" and insert therefor -- 3,947,180 --.

Column 6, line 13, delete "a" and insert therefor - A --.

Signed and Sealed this

Second Day of December,1997

Bruce Lehman

*Attest:*

BRUCE LEHMAN

*Attesting Officer*

*Commissioner of Patents and Trademarks*